US005581230A

United States Patent [19]

Barrett

[11] Patent Number: 5,581,230

[45] Date of Patent: Dec. 3, 1996

[54] ILLUMINATED DOOR HANDLE ASSEMBLY

[75] Inventor: Robert R. Barrett, Lexington, Mich.

[73] Assignee: Amerisafe Corporation, Southfield, Mich.

[21] Appl. No.: 369,115

[22] Filed: Jan. 5, 1995

[51] Int. Cl.[6] ..... G08B 5/00

[52] U.S. Cl. ..... 340/332; 340/434; 340/468; 340/472; 340/431; 340/815.42; 362/32; 362/100; 362/80; 116/202

[58] Field of Search ..... 340/332, 431, 340/434, 468, 472; 362/32, 100, 80; 116/202

[56] References Cited

U.S. PATENT DOCUMENTS 2,225,151 12/1940 Borba .
2,245,349 6/1941 Lombardi .
2,358,867 9/1944 Madan .
3,510,643 5/1970 File .
4,041,301 8/1977 Pelchat ..... 362/100
4,777,570 10/1988 Littles ..... 362/100
5,003,437 3/1991 Barrett .
5,297,010 3/1994 Camarota et al. ..... 362/80

*Primary Examiner*—Jeffery Hofsass
*Assistant Examiner*—Daryl C. Pope
*Attorney, Agent, or Firm*—Bliss McGlynn, P.C.

[57] ABSTRACT

An illuminated door handle assembly includes a door handle seamed to a door at a defined location and moveable between latching and unlatching positions, a signal generator for transforming energy into a signal and an energy receiver in communication with the signal generator for receiving the signal therefrom and conducting the signal to the door handle such that the signal is emitted from the door handle to indicate the location thereof.

12 Claims, 2 Drawing Sheets

ILLUMINATED DOOR HANDLE ASSEMBLY

BACKGROUND OF THE INVENTION

1. Field of the Invention

The present invention relates generally to door handles and, more particularly, to door handles readily locatable without ambient light.

2. Description of the Related Art

It is well known to use a door handle to both unlatch a door and push the door open. Difficulties arise, however, when the environment is dark, either due to the main lights being turned off or due to a power failure. Panic commonly occurs when the power fails and is intensified when the power failure results from an emergency situation, such as a fire. It is often difficult to locate the door and/or the door handles when the lights are not operating, especially during a panic situation such as a fire.

SUMMARY OF THE INVENTION

Accordingly, an illuminated door handle assembly for latching and unlatching a door includes a door handle secured to a door at a defined location. The door handle is moveable between a latching and an unlatching position. The illuminated door handle assembly also includes a signal generator for transforming energy into a signal and an energy receiver in communication with the signal generator for receiving the signal from the signal generator and conducts the signal to the door handle such that the signal is emitted from the door handle to indicate the location thereof.

One advantage of the present invention is that an illuminated door handle assembly is provided for a door. Another advantage of the present invention is that the illuminated door handle assembly has the ability to readily locate the door handle When the environment is darkened.

Other objects, features and advantages of the present invention will be readily appreciated as the same becomes better understood after reading the subsequent description taken in conjunction with the accompanying drawings.

DESCRIPTION OF THE PREFERRED EMBODIMENT(S)

Figure 1:
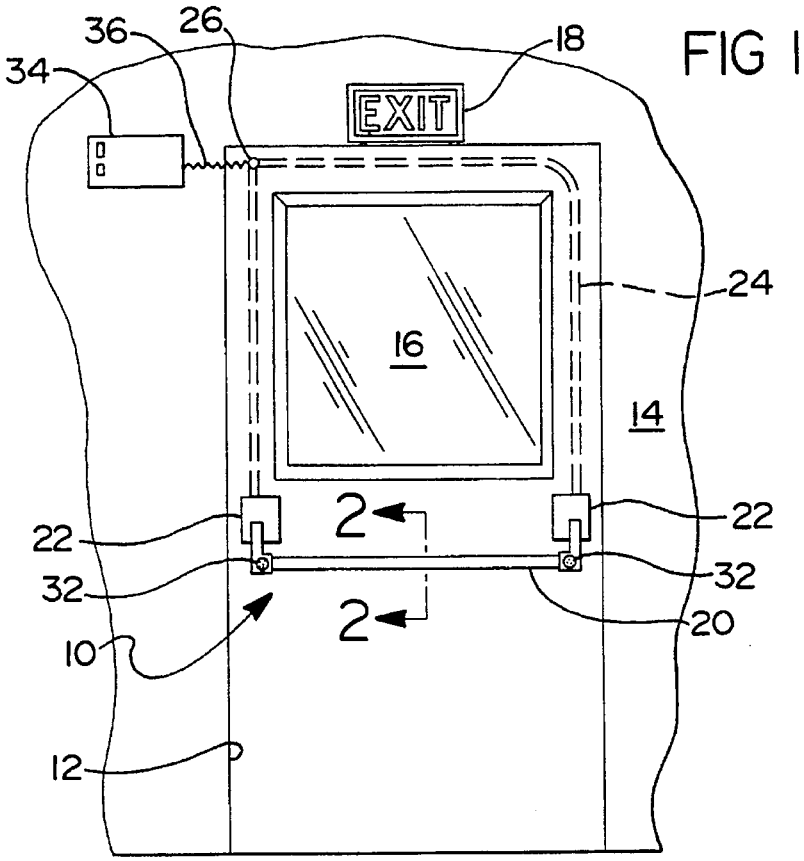
FIG. 1 is a front view of an illuminated door handle assembly according to the present invention.

Referring to FIG. 1, one embodiment of an illuminated door handle assembly, according to the present invention, is shown at 10. The assembly 10 is associated with a door 12 which selectively provides a barrier in an opening in a wall 14 of a building. The door 12 is shown to include a window 16 located in an upper portion of the door 12. An exit sign 18 is mounted to the wall 14 above the door 12. Although the assembly 10 is shown in an embodiment associated with a building door, it should be appreciated the present invention may be of any suitable type of handle used in association with any suitable type of door. By way of example, the present invention may be used in conjunction with a vehicle such as a bus.

The assembly 10 also includes a door handle 20 which is secured to the door 12 at a defined location. The door handle 20 is mounted to the door 12 using mounting brackets 22. The mounting brackets 22 allow the door handle 20 to pivot with respect to the door 12. The door handle 20 is movable or pivotable between latching and unlatching positions. Typically, the unlatching position is closer to the door 12 to facilitate pushing the door 12 open. It should be appreciated that similar door handles other than the one just described, such as a door handle 20" shown in FIG. 4, may be used without deviating from the scope of the present invention.

The assembly 10 further includes an energy receiver 24 which receives energy from a signal generator 26, to be described, and conducts the energy to the door handle 20. In one embodiment of the present invention, the energy receiver 24 is a fiber optic cable extending through the door 12 and mounting brackets 22 to the door handle 20. In the preferred embodiment, the signal generator 26 is a light emitting source in communication with the energy receiver 24 for transforming the energy from a main power source (not shown) into a signal such that the signal indicates the location of the door handle 20. In this way, energy in the form of light is generated from the signal generator 26 and transmitted through the energy receiver 24 where losses, in the form of the dissipation of the light are permitted at the door handle 20, giving the appearance that the door handle 20 is glowing or illuminated.

Figure 2:
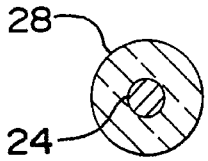
FIG. 2 is a sectional view taken along line 2—2 of FIG. 1.

Referring to FIG. 2, the door handle 20 includes a handle covering 28 and a support structure 30 extending therethrough. The handle covering 28 is fabricated from a material capable of transmitting light therethrough. More specifically, the material may either be transparent or translucent. In one embodiment, the material is a plastic commercially available under the trademark LEXAN.

The assembly 10 may include a sound generator 32. The sound generator 32 emits audible signals which are to emanate from the door handle 20 in addition to the signal generator 26 to further aid the operator in locating the door handle 20. As illustrated in FIGS. 1 and 2, two sound generators 32, in the form of speakers, are located at either end of the door handle 20 and may emit either an intelligible signal or merely sound an alarm.

The assembly 10 may also include an auxiliary power supply 34 connected to the assembly 10 to power the assembly 10 when main power to the signal generator 26 is interrupted. The auxiliary power supply 34 incorporates a charging device which will charge the auxiliary power supply 34 when the main power is operating, thus insuring the auxiliary power supply 34 has stored the maximum amount of potential.

The assembly 10 further includes a hinged electrical connection 36 for connecting the signal generator 26 and the auxiliary power supply 34. The hinged electrical connection 36 maintains a connection between the signal generator 26 and the auxiliary power supply 34 when the door 12 is being moved between the closed and opened positions.

Figure 3:
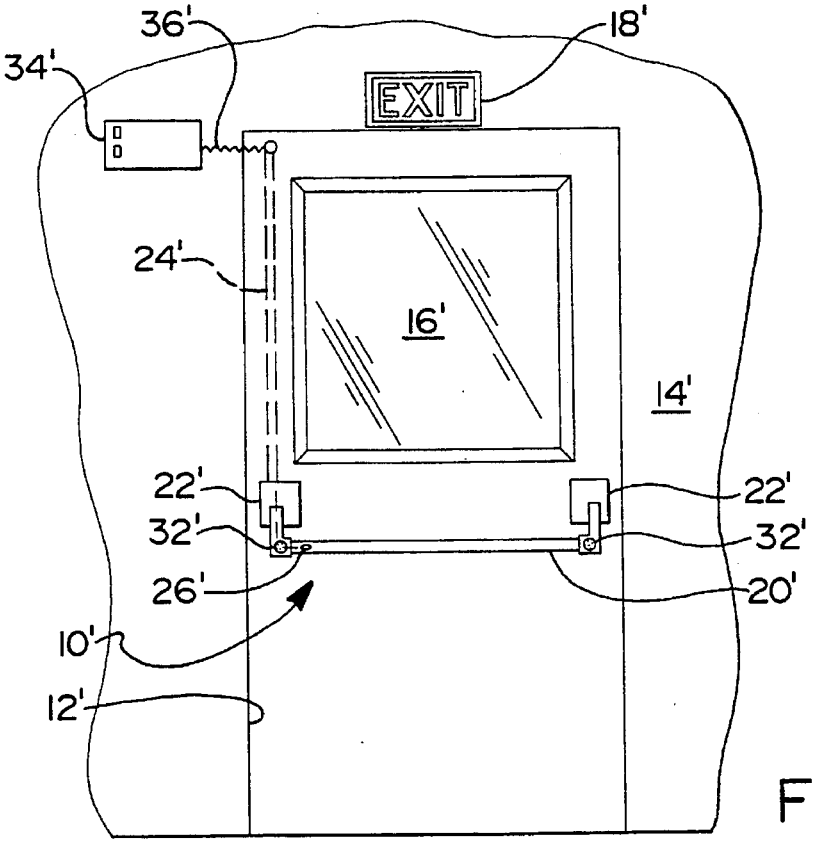
FIG. 3 is a front view of a first alternative embodiment of the illuminated door handle assembly of FIG. 1.

In a first alternative embodiment illustrated in FIG. 3, wherein like prime numerals represent similar structure, the energy receiver 24' is an electrical conductor, such as a copper wire or any other conducting material in the form of a wire. Also, the light source 26' is located at the door handle 20 and light is dissipated through the door handle 20.

Figure 4:
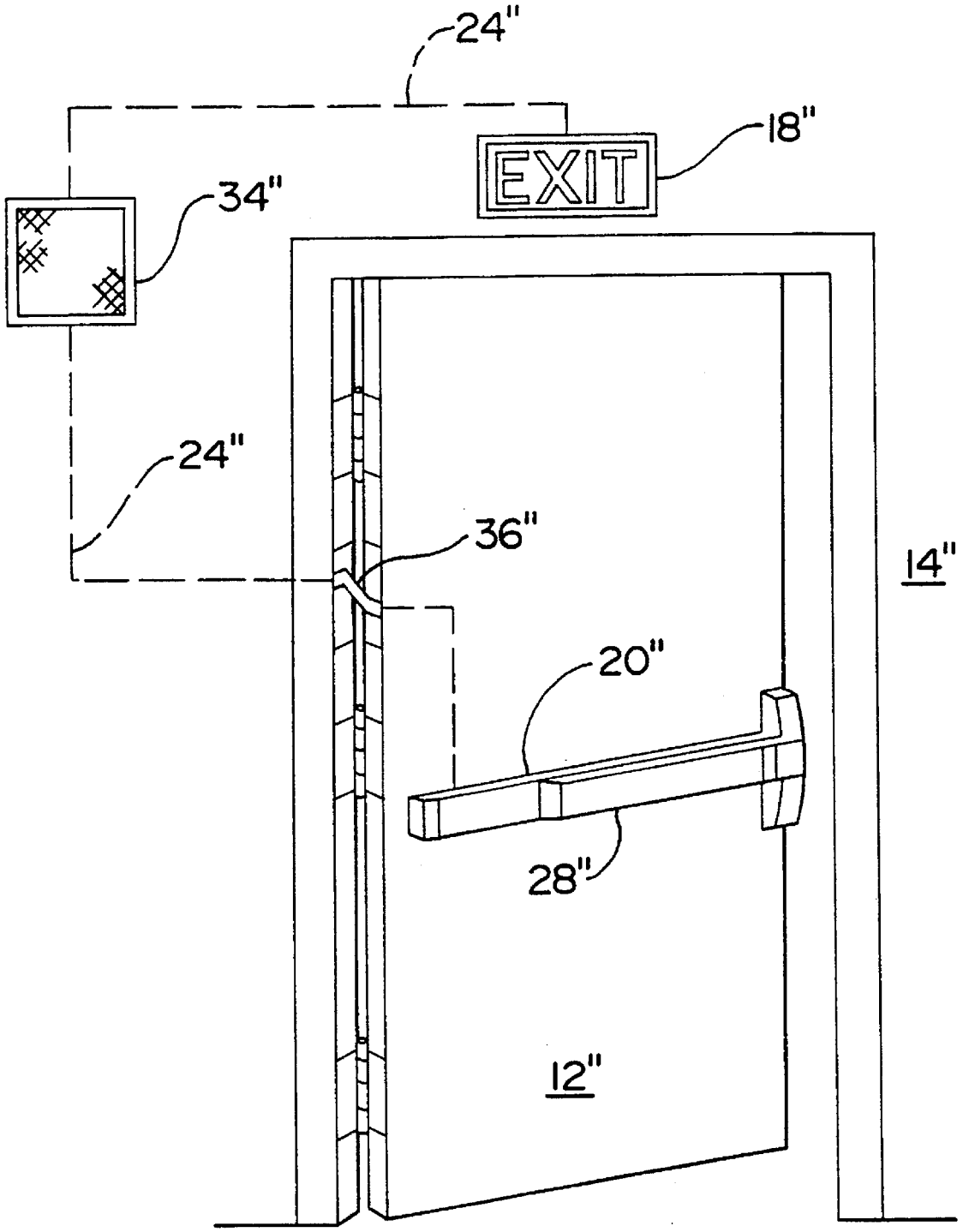
FIG. 4 is a front view of a second alternative embodiment of the illuminated door handle assembly with the door ajar.

In a second alternative embodiment shown in FIG. 4, the door handle 20" does not extend the width of the door 12"

The signal generator 34" is connected to the door handle 20" through a signal conductor 24" via a hinged connection 36" to the handle covering 28" which is a light dissipating medium. In this embodiment, the exit sign is also connected to the signal generator 34" through a signal conductor 24".

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. An illuminated door handle assembly for latching and unlatching a door having a predetermined width, said illuminated door handle assembly comprising:

a door handle secured to the door at a defined location and moveable between latching and unlatching positions, said door handle having a handle portion extending across a majority of the predetermined width of the door;

a signal generator for transforming energy into a signal; and an energy receiver in communication with said signal generator for receiving the signal from said signal generator and conducting the signal to said door handle such that the signal is emitted out from said door handle along all of said handle portion to indicate said defined location of said door handle.

2. An illuminated door handle assembly as set forth in claim 1 wherein said signal generator is a light emitting source for emitting light at said defined location.

3. An illuminated door handle assembly as set forth in claim 1 wherein said energy receiver is a fiber optic cable.

4. An illuminated door handle assembly as set forth in claim 1 including an auxiliary power supply electrically connected to said signal generator to create auxiliary energy usable by said signal generator.

5. An illuminated door handle assembly as set forth in claim 4 including a hinged electrical connection for connecting said signal generator with said auxiliary power supply.

6. An illuminated door handle assembly for latching and unlatching a door having a predetermined width, said illuminated door handle assembly comprising:

a door handle secured to the door at a defined location and moveable between latching and unlatching positions, said door handle extending across a majority of the predetermined width of the door;

a signal generator for transforming energy into a signal; and an electrical conductor in communication with said signal generator for receiving the signal therefrom and conducting the signal to said door handle such that the signal is emitted out radially and axially along said door handle to indicate said defined location of said door handle.

7. An illuminated door handle assembly for latching and unlatching a door having a predetermined width, said illuminated door handle assembly comprising:

a door handle secured to the door at a defined location and movable between latching and unlatching position, said door handle defining a handle portion extending across a majority of the predetermined width of the door, said handle portion being fabricated from a light transmitting material;

a light emitting source for emitting light; and an energy receiver in communication with said light emitting source for receiving the emitted light therefrom and conducting the emitted light to said handle portion such that the emitted light is emitted out from said handle portion along said handle portion to indicate said defined location of said door handle.

8. An illuminated door handle assembly for latching and unlatching a door having a predetermined width, said illuminated door handle assembly comprising:

a door handle secured to the door at a defined location and moveable between latching and unlatching position, said door handle having a handle portion extending across a majority of the predetermined width of the door;

a light emitting source for transforming energy into a signal; and a fiber optic cable in communication with said light emitting source for receiving the signal from the light emitting source and conducting the signal to said door handle such that said signal is emitted out from said door handle along all of said handle portion to indicate the defined location thereof.

9. An illuminated door handle assembly for latching and unlatching a door having a predetermined width, said illuminated door handle assembly comprising:

a door handle secured to the door at a defined location and movable between latching and unlatching positions, said door handle including a handle portion fabricated from a light transmitting material and extending across a majority of the predetermined width of the door;

a light emitting source for transforming energy into a signal; and a fiber optic cable in communication with said light emitting source for receiving the signal from said light emitting source and conducting the signal to said handle portion such that the signal is emitted out from said handle portion radially and axially along all of said handle portion to indicate said defined location thereof.

10. An illuminated door handle assembly for latching and unlatching a door having a predetermined width, said illuminated door handle assembly comprising:

a door handle secured to the door at a defined location and movable between latching and unlatching positions, said door handle having a handle portion extending across a majority of the predetermined width of the door;

a light emitting source for transforming energy into a signal;

a fiber optic cable in communication with said light emitting source for receiving the signal from said light emitting source and conducting the signal to said door handle such that the signal is emitted out from said door handle radially and axially along all of said handle portion to indicate said defined location of said door handle; and an auxiliary power supply electrically connected to said light emitting source to create auxiliary energy usable by said light emitting source.

11. An illuminated door handle assembly for latching and unlatching a door having a predetermined width, said illuminated door handle assembly comprising:

a door handle secured to the door at a defined location and movable between latching and unlatching positions, said door handle including a handle portion extending across a majority of the predetermined width of the door;

a light emitting source for transforming energy into a signal;

a fiber optic cable in communication with said light emitting source for receiving the signal from said light emitting source and conducting the signal to said door handle such that the signal is emitted out from said door handle radially and axially along all of said handle portion to indicate said defined location thereof;

an auxiliary power supply electrically connected to said light emitting source to create auxiliary energy usable by said light emitting source; and a hinged electrical connection for connecting said light emitting source with said auxiliary power supply.

12. An illuminated door handle assembly for latching and unlatching a door having a predetermined width, said illuminated door handle assembly comprising:

a door handle secured to the door at a defined location and movable between latching and unlatching positions;

a signal generator for transforming energy into a signal; and an energy receiver in communication with said signal generator for receiving the signal from said signal generator and conducting the signal to said door handle, said energy receiver including an outer surface such that a portion of said outer surface provides losses of the signal to allow said door handle to glow along a length thereof.

* * * * *

UNITED STATES PATENT AND TRADEMARK OFFICE

CERTIFICATE OF CORRECTION

PATENT NO. : 5,581,230

DATED : December 3, 1996

INVENTOR(S) : Robert R. Barrett

It is certified that error appears in the above-indentified patent and that said Letters Patent is hereby corrected as shown below:

Column 1, line 36, "When", should be -- when --.

Column 3, line 4, after "sign" insert -- 18" --.

Column 4, claim 8, line 12, "position" should be -- positions --.

Signed and Sealed this

Twentieth Day of May, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,581,230

DATED : December 3, 1996

INVENTOR(S) : Robert R. Barrett

It is certified that error appears in the above-indentified patent and that said Letters Patent is hereby corrected as shown below:

Column 2, line 31, "a support structure 30" should be --the energy receiver 24--.

Signed and Sealed this

Twenty-fourth Day of June, 1997

Bruce Lehman

*Attest:*

BRUCE LEHMAN

*Attesting Officer*

*Commissioner of Patents and Trademarks*